US009712917B2

(12) United States Patent
Clark et al.

(10) Patent No.: US 9,712,917 B2
(45) Date of Patent: Jul. 18, 2017

(54) SPEAKER SYSTEM

(71) Applicant: Audio Icons, LLC, Athens, GA (US)

(72) Inventors: Kevin Clark, Athens, GA (US); Ted Mayer, Athens, GA (US)

(73) Assignee: Audio Icons, LLC, Athens, GA (US)

( * ) Notice: Subject to any disclaimer, the term of this patent is extended or adjusted under 35 U.S.C. 154(b) by 0 days.

(21) Appl. No.: 14/833,997

(22) Filed: Aug. 24, 2015

(65) Prior Publication Data

US 2016/0057538 A1 Feb. 25, 2016

Related U.S. Application Data

(60) Provisional application No. 62/040,550, filed on Aug. 22, 2014, provisional application No. 62/173,060, filed on Jun. 9, 2015.

(51) Int. Cl.

| | |
|---|---|
| ***H04R 3/12*** | (2006.01) |
| ***A42B 3/30*** | (2006.01) |
| ***H04R 1/02*** | (2006.01) |
| ***H04R 31/00*** | (2006.01) |

(52) U.S. Cl.

CPC ..... *H04R 3/12* (2013.01); *A42B 3/306* (2013.01); *H04R 1/02* (2013.01); *H04R 31/00* (2013.01); *H04R 2201/023* (2013.01); *H04R 2201/029* (2013.01); *H04R 2420/07* (2013.01)

(58) Field of Classification Search

CPC . H04R 3/12; H04R 1/02; H04R 31/00; H04R 2201/023; H04R 2420/07; H04R 2201/029; A42B 3/306

See application file for complete search history.

(56) References Cited

U.S. PATENT DOCUMENTS

| | | | | |
|---|---|---|---|---|
| 2,904,645 A | | 9/1959 | Sarles | |
| 4,179,585 A | * | 12/1979 | Herrenschmidt | H04R 5/02 181/147 |
| 5,142,700 A | | 8/1992 | Reed | |
| 6,118,876 A | * | 9/2000 | Ruzicka | H04R 5/04 381/18 |

(Continued)

FOREIGN PATENT DOCUMENTS

| | | | | |
|---|---|---|---|---|
| GB | 727458 A | * | 3/1955 | H04R 1/02 |

OTHER PUBLICATIONS

Helmet & Speaker Set Item: 7214000XX; Schutt Sports; schuttsports.com; 2007.

*Primary Examiner* — Brenda Bernardi
(74) *Attorney, Agent, or Firm* — The Webb Law Firm

(57) ABSTRACT

A speaker system may include a dome-shaped shell defining an internal cavity, a receiver configured to receive audio signals from a wireless-enabled device and positioned in the internal cavity, and a plurality of speakers positioned at least partially within the internal cavity and in audio communication with the receiver, wherein the wireless receiver and speakers are configured to project audio outward of the dome-shaped shell. At least some of the plurality of speakers are facing outward of the dome-shaped shell, wherein the at least some of the plurality of speakers are at least partially upward and partially forward facing and configured to project audio outward of the dome-shaped shell in at least a partially forward direction. Some of the plurality of speakers could also be forward facing and downward facing. The shell can take the form of a sports helmet.

18 Claims, 5 Drawing Sheets

(56) References Cited

U.S. PATENT DOCUMENTS

| | | | | |
|---|---|---|---|---|
| D465,067 | S | 10/2002 | Ide et al. | |
| D511,026 | S | 10/2005 | Ide et al. | |
| 6,970,691 | B2 * | 11/2005 | Thompson | A42B 3/30 2/422 |
| D528,705 | S | 9/2006 | Ide et al. | |
| D603,099 | S | 10/2009 | Bologna et al. | |
| D603,100 | S | 10/2009 | Bologna | |
| 7,862,194 | B2 | 1/2011 | Seade | |
| 8,014,556 | B2 | 9/2011 | Goldberg | |
| 8,107,664 | B2 | 1/2012 | Mao | |
| D681,280 | S | 4/2013 | Bologna et al. | |
| D681,281 | S | 4/2013 | Bologna et al. | |
| 8,491,146 | B2 | 7/2013 | Seade | |
| 2008/0295224 | A1 | 12/2008 | Mintzer | |
| 2012/0300962 | A1 * | 11/2012 | Devoto | H04R 5/02 381/300 |
| 2013/0177198 | A1 * | 7/2013 | Hogue | H04R 3/12 381/394 |

* cited by examiner

SPEAKER SYSTEM

CROSS REFERENCE TO RELATED APPLICATIONS

This application claims the benefit of priority from U.S. Provisional Patent Application No. 62/040,550, filed Aug. 22, 2014, and 62/173,060, filed Jun. 9, 2015, both of which are herein incorporated by reference in their entirety.

BACKGROUND OF THE INVENTION

Field of the Invention

The present invention is directed to a speaker system, and, in particular, a speaker system incorporating speakers into a dome-shaped shell, such as in the shape of a sports helmet, and capable of receiving audio signals from an audio source.

Description of Related Art

Speaker systems often come in the form of multiple, separate speakers, and often are box-like and unattractive. Some speaker systems have been designed to be decorative, including speakers designed for the sports fan, such as the football helmet and speaker set available at http://www.schuttsports.com/aspx/Sport/ProductCatalog.aspx?id=277.

However, there are at least some problems with fully contained speaker systems that are at least partially dome shaped due to the difficulty in obtaining a speaker system that includes high quality audio comparable to higher end speaker systems, due to the shape of the system. Available speaker systems do not optimize the positioning of the various components, including, but not limited to, the speakers, such as tweeters and subwoofers, in order to project audio outward for high-quality, rich, clear sound. This is especially true of dome-shaped speakers, such as those designed to replicate sports helmets. Moreover, there is a lack of wireless technology, such as Bluetooth®, used in such speaker systems for receiving a wireless audio signal, such as from an external audio source.

SUMMARY OF THE INVENTION

An embodiment of a speaker system may include a dome-shaped shell defining an internal cavity; a receiver configured to receive audio signals from a wireless-enabled device and positioned in the internal cavity; and a plurality of speakers positioned at least partially within the internal cavity and in audio communication with the receiver, wherein the wireless receiver and speakers are configured to project audio outward of the dome-shaped shell. At least some of the plurality of speakers can be facing outward of the dome-shaped shell such that they are at least partially upward and partially forward facing and configured to project audio outward of the dome-shaped shell in at least a partially forward direction. A first speaker of the at least partially upward and partially forward-facing speakers can be partially leftward facing and a second speaker of the at least partially upward and partially forward-facing speakers can be partially rightward facing. At least some of the plurality of speakers may be outward and forward facing of the dome-shaped shell and configured to project audio outward of the dome-shaped shell in at least a partially forward direction. At least some of the plurality of speakers may be positioned entirely within the internal cavity and are downward facing. Also, the downward-facing speakers may further be at least partially forward facing. The plurality of speakers may include a first plurality of speakers that are outward and forward facing of the dome-shaped shell and a second plurality of speakers that are positioned entirely within the internal cavity and are downward and forward facing, wherein the first and second plurality of speakers are configured to project audio outward of the dome-shaped shell in at least a partially forward direction. The second plurality of speakers could be subwoofers. The first plurality of speakers could be tweeters. A first cabinet and a second cabinet may be positioned inside the dome-shaped shell. At least one speaker of each of the first plurality of speakers and second plurality of speakers could be positioned at least partially within the first cabinet and second cabinet, respectively. Also, the speaker system could include a plurality of cabinets positioned inside the dome-shaped shell, wherein each speaker of the first plurality of speakers has a corresponding cabinet in which each speaker of the first plurality of speakers is at least partially positioned within, and each speaker of the second plurality of speakers is positioned at least partially within a cabinet of the plurality of cabinets. In some embodiments, the dome-shaped shell could be the shape of a sports helmet, such as a football helmet. Also, the shell could be a regulation sized football helmet. In some embodiments, the receiver may be a Bluetooth® receiver. The system may also include an audio source in communication with the receiver, which, in some embodiments, may be a mobile device, such as a smartphone or a tablet computer.

An embodiment of a method of audio projection may include receiving a wireless audio signal inside an internal cavity of a dome-shaped shell; projecting audio from at least one upward and forward-facing speaker on the dome-shaped shell; and projecting audio from at least one downward and forward-facing speaker from inside the internal cavity. An embodiment of a method of manufacturing a speaker system may include providing a dome-shaped shell having an internal cavity; positioning at least one speaker in the dome-shaped cavity in a downward and forward-facing direction; positioning at least one speaker at least partially in the dome-shaped cavity in an upward and forward-facing direction; connecting the speakers in audio communication with a wireless receiver positioned inside the internal cavity, such that audio may be projected from the speakers outward of the dome-shaped shell in at least a partially forward direction.

Another embodiment of a speaker system may include a sports helmet shell having a front opening; a wireless receiver configured to receive audio from a wireless-enabled device; at least one speaker positioned above the front opening such that it is facing outward of the sports helmet shell and at least partially upward and at least partially forward; and at least one speaker positioned inside the sports helmet shell and facing outward of the front opening and at least partially downward and at least partially forward, wherein the wireless receiver is in audio communication with the speakers to project audio therefrom in a direction outward and forward of the sports helmet shell.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DESCRIPTION OF THE INVENTION

Figure 1:
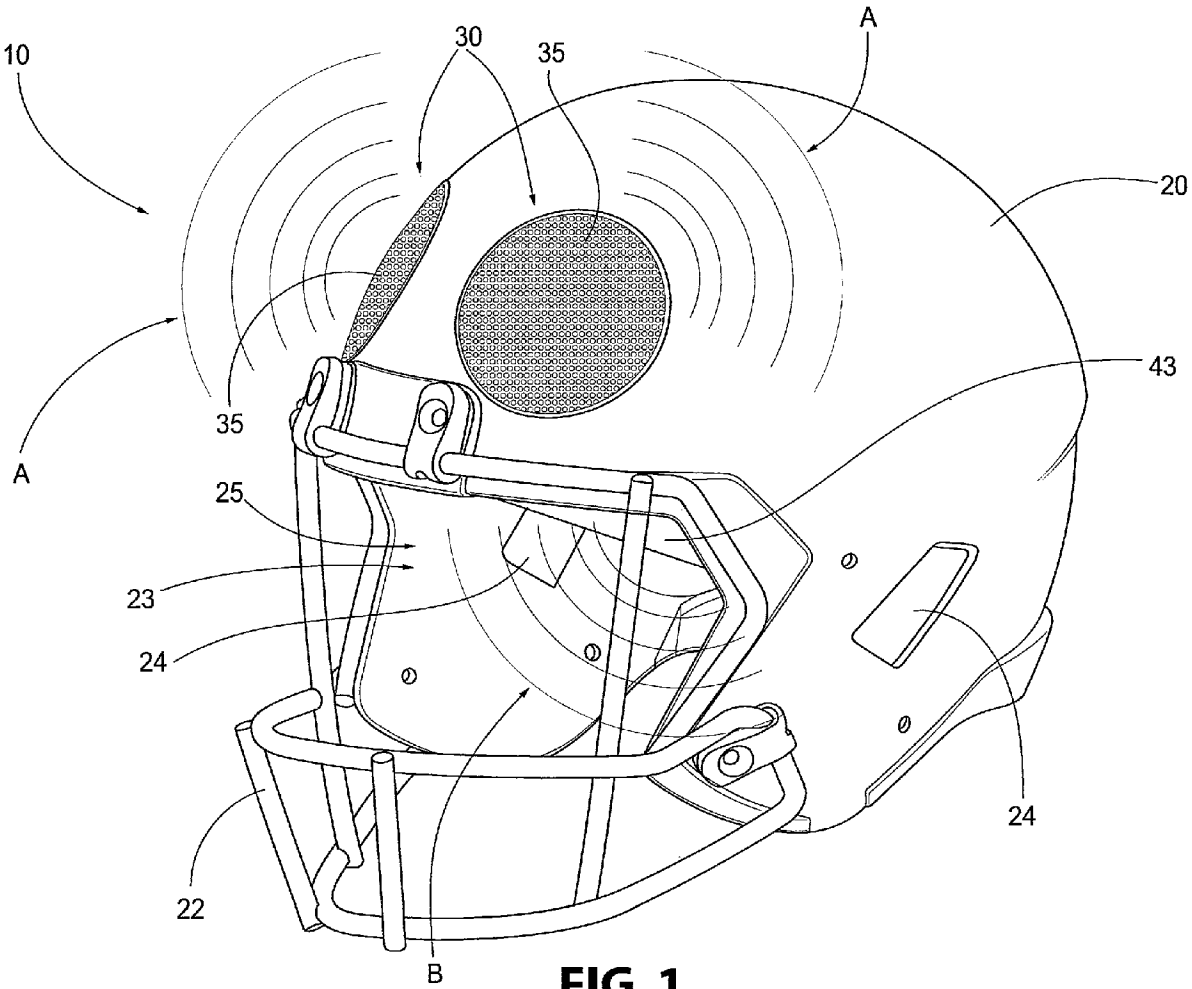
FIG. 1 is a perspective view of an embodiment of a speaker system according to the present invention.

For purposes of the description hereinafter, the terms "end", "upper", "lower", "right", "left", "vertical", "horizontal", "top", "bottom", "lateral", "longitudinal", "upward", "downward", "forward", "rear", and derivatives thereof shall relate to the invention as it is oriented in the drawing figures. However, it is to be understood that the invention may assume various alternative variations, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Audio communication, as used herein, means capable of transmitting audio signals between devices, components, or elements, whether by digital communication, electronically, wirelessly, through analog, or any other manner suitable to transmitting audio signals from one device, component, and/or element to another.

Referring now to FIG. 1, a speaker system 10, according to the present invention, may include a shell 20, which may, as illustrated, be dome shaped. The figures herein illustrate a dome-shaped shell 20 in the form of a sports helmet, and, in particular, a football helmet. The shell 20 may be constructed of polycarbonate, and, in the illustrated football helmet embodiment, may include a face shield/mask 22, ear holes 24, internal pads, and/or other features to replicate the authenticity of a true helmet. The shell may also be constructed of ABS plastic. Although the illustrated embodiment is that of a football helmet, the shell 20 may take any dome-like, spherical, or partially spherical form, such as other sports-related helmets (e.g., racing, baseball, or hockey helmets), or sports balls (e.g., baseballs, basketballs, golf balls, etc.). In the sports helmet-related embodiments, the helmet-shaped shell may be a regulation grade and/or sized helmet for any desired league or governing body, such as the NFL, NCAA, NHL, MLB, or others. Likewise, in the sports ball-related embodiments, the ball-shaped shell may be regulation sized, if so desired.

The shell 20 may include an internal cavity 25. In the illustrated embodiment, the cavity 25 includes a front opening 23, which, in the illustrated helmet embodiment, may take the form of the portion of the helmet through which a player's face would normally be seen if the helmet were wearable. But, as evident, herein, the illustrated embodiment is a speaker system, and is not intended to be used as a true, useable, wearable football helmet. In some embodiments, all components of the audio receiving and/or amplifying system, with the exception of various control components and the outwardly-facing portions of corresponding speakers, such as a wireless receiver, crossovers, amplifier, battery, etc., can be confined within the speaker system shell 20 in the internal cavity 25. This can, thus, hide the internals of the speaker system 10 providing a desirable appearance.

Figure 2:
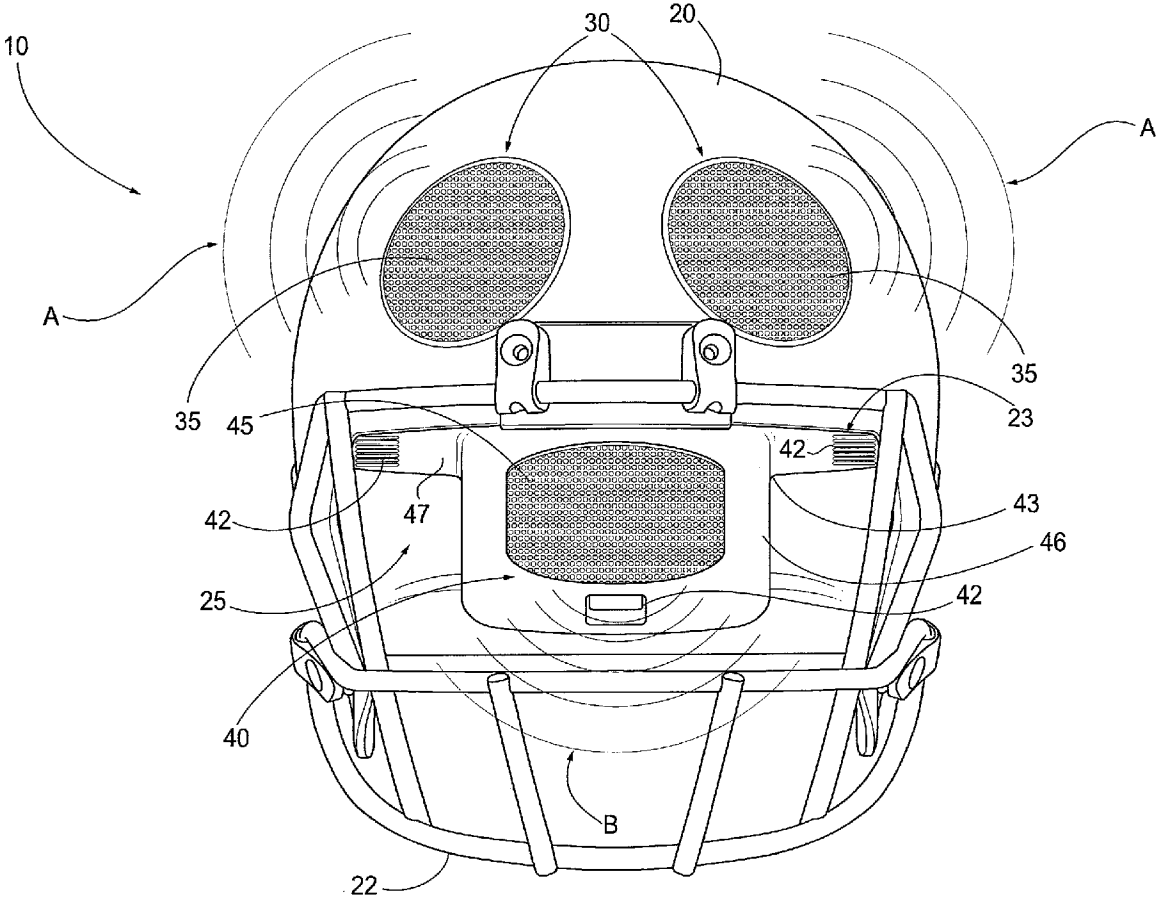
FIG. 2 is a front view of the speaker system of FIG. 1.
Figure 5:
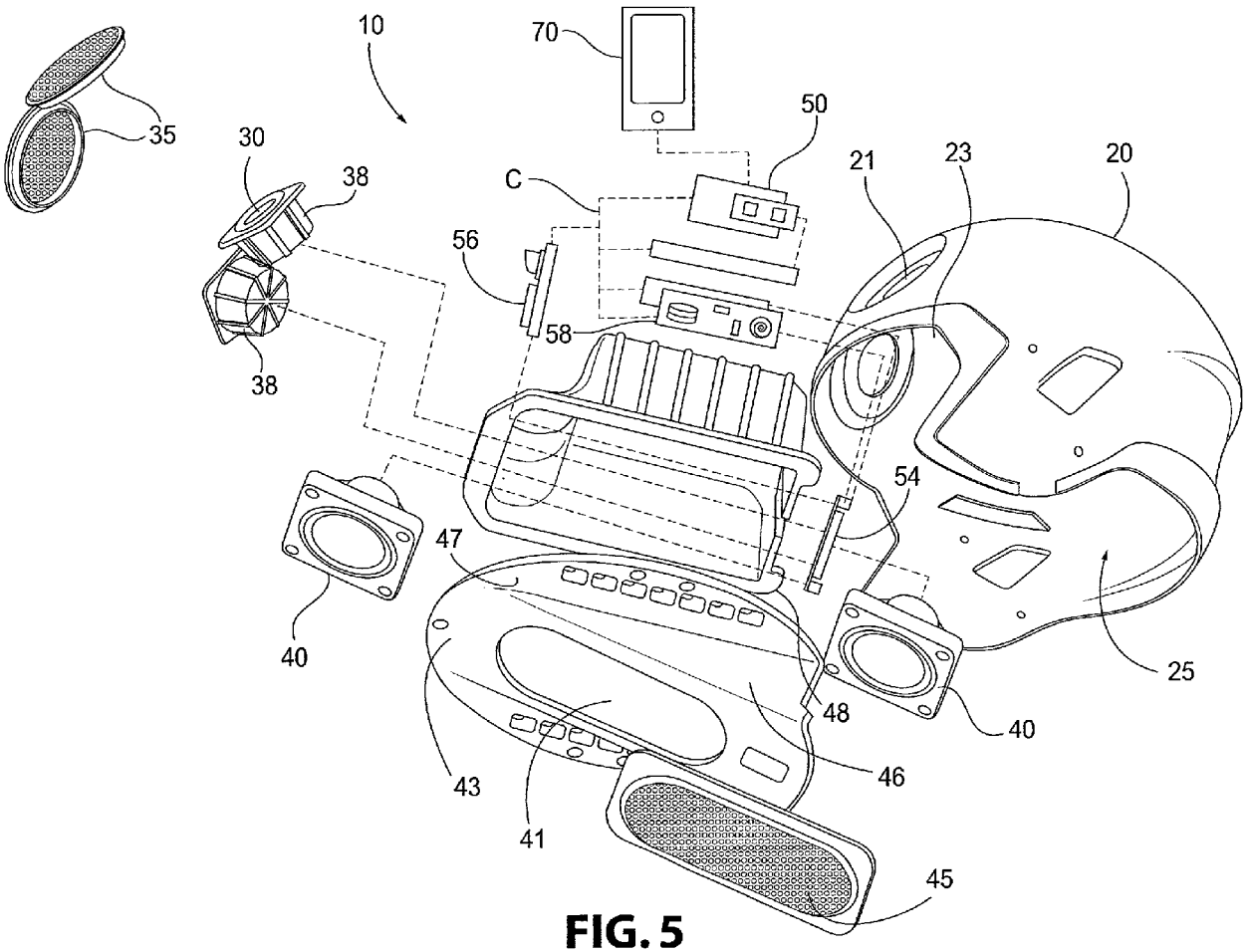
FIG. 5 is an exploded view of the speaker system of FIG. 1.

As further shown in FIGS. 1, 2, and 5, the speaker system 10, may include a plurality of speakers, such as upper speakers 30. In some embodiments, the upper speakers 30 may be speakers having mid to high range frequencies and/or may be tweeters. In some embodiments the speakers 30 could be 1-inch tweeters and/or mid-range speakers. A speaker grille 35 may also be provided, which may be a mesh, fabric, metal, or any suitable speaker cover material. The upper speakers 30 are positioned such that they are configured to project audio outward of the dome-shaped shell 20. In the illustrated embodiment, the upper speakers 30 are positioned such that they project audio in partially forward, partially upward, and left and right lateral directions, such as depicted by detail lines A in FIGS. 1 and 2. This is accomplished by positioning the speakers 30 in the internal cavity 25 of the shell 20, such that they are outwardly facing from a top portion of the shell 20. As illustrated, the outwardly facing portion, and thus, the diaphragm portion of the speakers 30, are positioned above the front opening 25 and face mask 22. In this position, the speakers 30 are positioned in an at least partially upward direction. As shown, the speakers 30 are laterally separated at least some distance, which may be predetermined, such that one speaker 30 is facing in at least a partially right lateral direction, and the other speaker 30 is facing in at least a partially left lateral direction. This configuration results in the projection of audio described above and as illustrated by detail lines A. As shown, positioning the speakers 30, such that the speakers 30, including the speaker grilles 35, are flush or nearly flush with the dome-shaped shell 20, results in this particular configuration due, in part, to the partially dome or spherical shape of the shell 20. However, other embodiments, wherein the speakers 30 are not flush or nearly flush with the shell are also contemplated herein. Although depicted as a plurality of speakers, alternatively, in some embodiments, a single upper speaker may be used. Additionally, any particular positioning of the speakers 30 (or single speaker) is contemplated by the present invention as long as the speakers are configured to project audio in at least a partially upward and partially forward direction.

Figure 4:
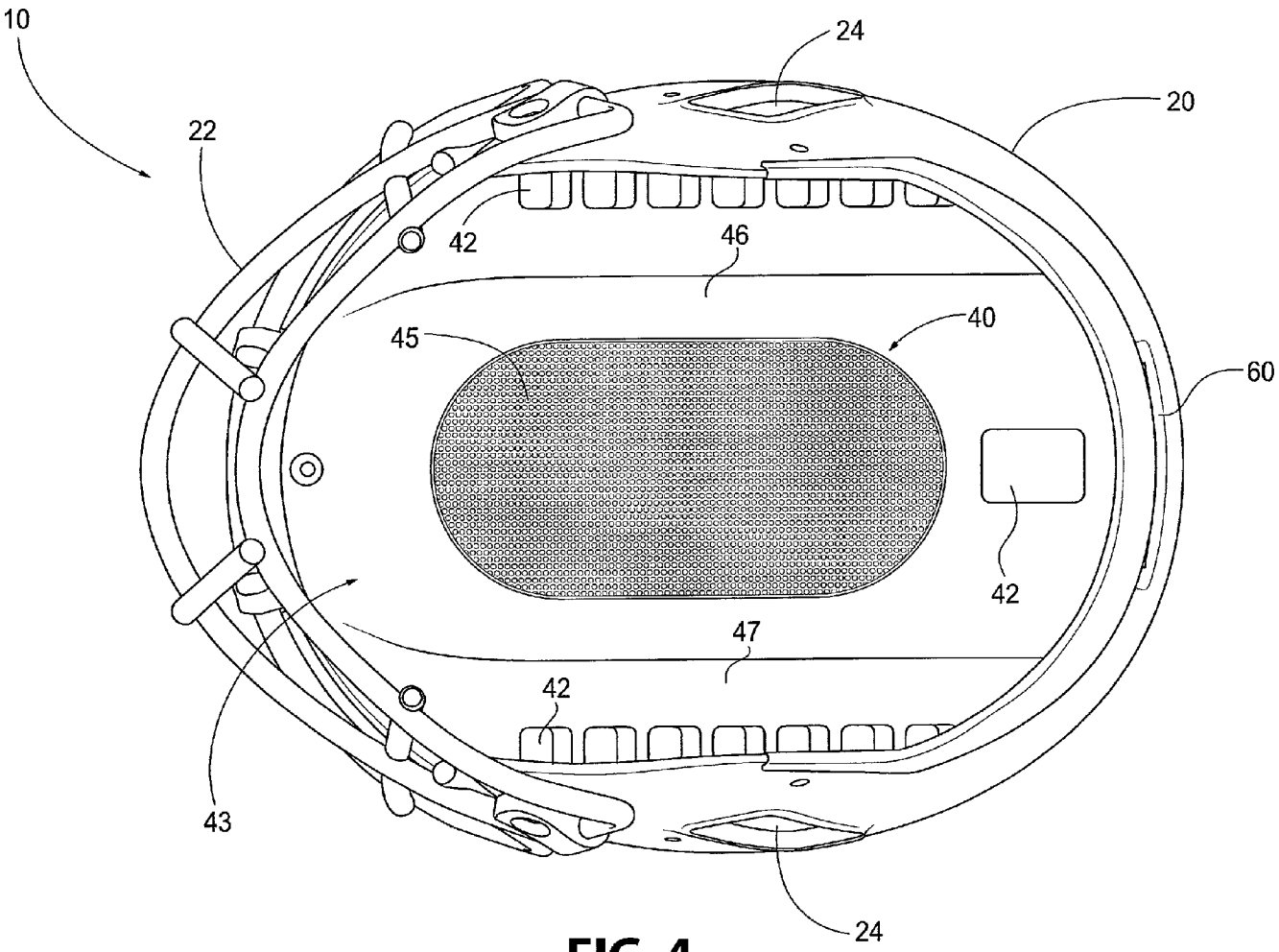
FIG. 4 is a bottom view of the speaker system of FIG. 1.

Now referring to FIGS. 2, 4, and 5, the speaker system 10 may also include lower speakers 40. These lower speakers 40 may be subwoofers, and, in some embodiments may be 3 inch subwoofers. A speaker grille 45 may also be included, which, like speaker grilles 35, may be a mesh, fabric, metal, or any suitable speaker cover material. The lower speakers 40 are positioned such that they are configured to project audio outward of the dome-shaped shell 20. In the depicted embodiment, the lower speakers 40 are positioned such that they project audio in at least a partially forward, partially downward direction through the front opening 23 of the shell 20, such as illustrated by detail lines B in FIGS. 1 and 2. As depicted, and as shown more clearly in FIG. 5, lower speakers 40 may include a plurality of speakers 40. However, it is also contemplated that a single speaker may be used in the lower speaker position. The projection of audio in a partially forward and partially downward direction is accomplished by positioning the speakers 40, such that their outwardly facing portions, and thus diaphragm portions, are aimed partially forward and partially downward. As illustrated, the speakers 40 are positioned such that their diaphragm portions are in the same plane. By dropping that plane down at an angle, such that the speakers 40 are facing partially forward and partially downward, the above-described positioning and projection of audio can be achieved. In a speaker system, such as described herein, positioning the speakers 40 such that they are angled in a partially forward direction provides a significant advantage in audio projection over speakers that are aimed straight down. This drop can be, for example, 2 inches between the top and most forward position of the front speaker 40 and the bottom and most rear portion of the rear speaker 40. This positioning provides the additional advantage that additional room is created in the internal cavity 25 for other components of the speaker system 10. For example, it would allow room for all jacks (e.g., power for charging and a stereo input) and a power switch, to be unobtrusively placed on the lower part of the back of the shell 20. Dropping the speakers 40, and associated cabinet 48 (described below), as illustrated herein, creates additional space for these components in the cavity 25, such that all internal portions of these components are contained within the shell 20, and permitting some flexibility for the desired placement of these and other electronic components. It may also create more room for other internal components, which are described in more detail below.

The configurations of speakers 30, 40 described herein can provide many benefits. For example, having both speakers 30 located at the front and top of the dome-shaped shell 20 provides optimal stereo separation, while the placement of the speakers 40 can provide an optimal bass response, particularly where the lower speakers 40 are subwoofers. With the lower speakers 40 aimed downward and forward, particularly where speakers 40 are subwoofers, the speakers 40 can project clear sound and add volume.

As shown most clearly in FIGS. 2, 4, and 5, a mounting plate 43 may be employed to effect the positioning of the speakers 40 and to hide the internal components, which may be undesirable from an aesthetic standpoint. In this regard, the mounting plate 43 is positioned and attached to the shell 20 in the internal cavity 25, and divides the internal cavity 25 into two portions, a user visible portion, and an internal component housing portion, which is hidden from a user. As illustrated, the mounting plate 43 has an angled speaker portion 46 and a substantially horizontal portion 47. The speakers 40 are positioned at least partially in the angled speaker portion 46. As such, the speaker portion 46 forms part of a speaker cabinet (in conjunction with a speaker cabinet 48 shown in FIG. 5) for speakers 40. The mounting plate 43 may also include apertures 42, as best seen in FIG. 4, which may be decorative and/or may provide air flow to the internal component housing portion of the internal cavity 25 and/or the speaker cabinet 48. The mounting plate 43 may be an extruded piece of material, such as plastic, or it may be constructed in any manner sufficient to accomplish the described and illustrated functions thereof. In some embodiments, the mounting plate 43 may be a form-fitting ⅜-inch plastic plate. However, any suitable mounting configuration is contemplated by this present disclosure.

Figure 3:
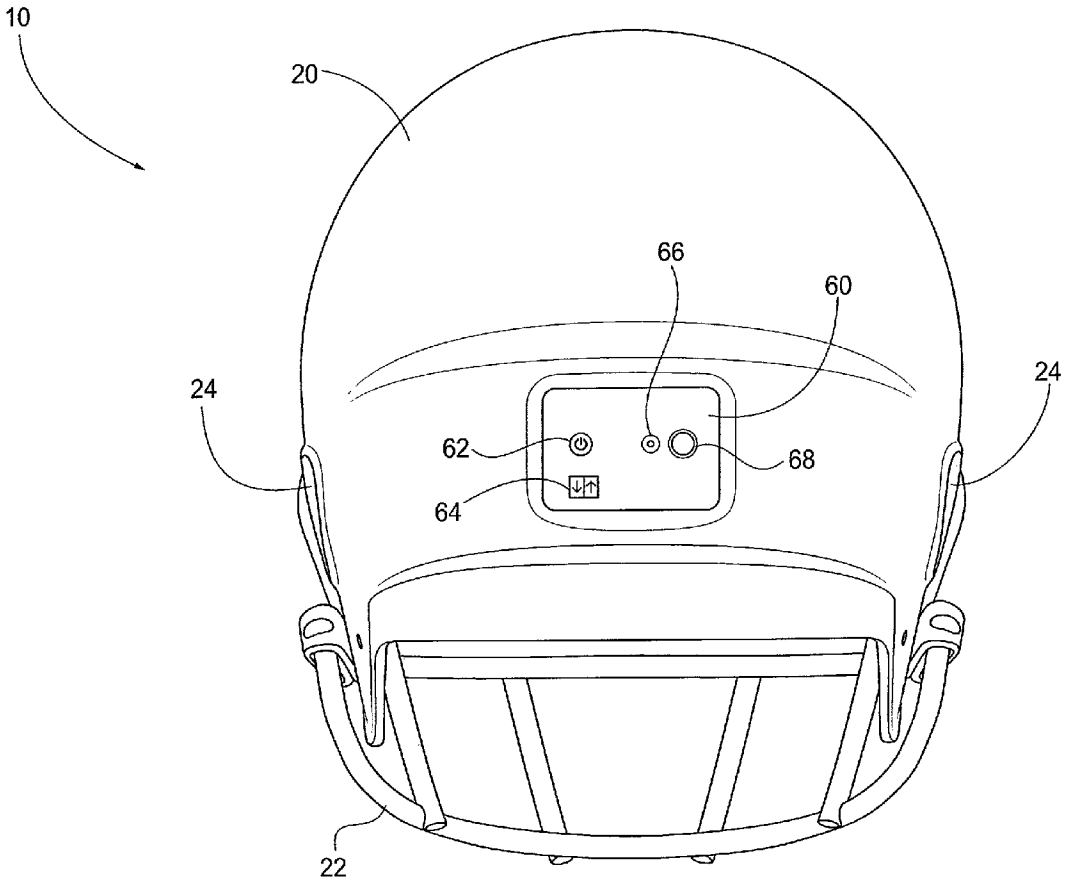
FIG. 3 is a rear view of the speaker system of FIG. 1.

Referring now to FIG. 3, the speaker system 10 may include a control panel 60, which may include one or more of a power switch 62, a volume control 64, a charging port 66, and/or an audio input jack 68 for non-wireless audio sources. The audio input jack 68 may take any form necessary to accomplish direct connection to a non-wireless audio source, such as a three-prong jack, a single-prong jack, a USB port, lightning port, or other non-wireless audio connection. In some embodiments, the control panel 60, including the on/off switching, can be accomplished by using a touch-sensitive capacitive switch, but any means of controlling the power, volume, and/or other aspects of the system 10 are also contemplated.

FIG. 5, which is an exploded view of the speaker system 10, shows the speaker cabinet 48, which, with the angled speaker portion 46, of the mounting plate 43 forms a cabinet for the lower speakers 40. The lower speakers 40 can be positioned such that their diaphragm portions are positioned in or proximate to the aperture 41 defined in the angled speaker portion 46 of the mounting plate 43. The speaker grille 45 may be then be placed over the diaphragm of the lower speakers 40 and the mounting plate 43 secured to the speaker cabinet 48 thereby creating a full speaker cabinet for the lower speakers 40. As illustrated herein, the upper speakers 30 each include a separate cabinet 38. The cabinets 38, and thus the speakers 30, are positioned inside the internal cavity 25 of the shell 20 proximate to apertures 21 such that the outwardly facing diaphragm portions of the speakers 30, also positioned in or proximate to the apertures 21, are facing externally of the shell 20 through apertures 21. The speaker grilles 35 may then be placed over the speakers 30. Although separate cabinets 38 for each of the speakers 30 are illustrated herein, it will be appreciated that a single cabinet 38 for enclosing both of the speakers 30 is also contemplated by the present invention. By including the various speakers, 30, 40 in cabinets 38, 48, as opposed to having any open back speakers, the speaker characteristics can be optimized.

Also shown in FIG. 5, there are other internal components that may be included in the speaker system 10 and are housed within cavity 25 of shell 20 such that they are hidden from view of a user. As shown, the system 10 may include one or more of the following: a receiver 50, a battery 52, an amplifier 54, a converter 56, and one or more crossovers 58. Each of these components may be in audio and/or electrical communication with each other and the speakers 30, 40 as illustrated by detail lines C to produce audio as contemplated herein. These components are hidden from view of the user (such as in the views of and in FIGS. 1-4 by the shell 20 and mounting plate 43). The receiver 50 is configured to receive audio signals (whether digital, wireless, electronic, analog, or otherwise) from an audio source 70, as illustrated by detail lines C between audio source 70 and receiver 50. Audio source 70 could take the form of a mobile device, such as a smartphone, mobile phone, a tablet computer, a laptop, or an MP3 player, or it could be a desktop computer, CD player, or other device capable of transmitting audio signals to receiver 50. In some embodiments where the receiver 50 is a wireless receiver, the receiver 50 may take the form of a Bluetooth® receiver capable of receiving Bluetooth® audio according to a Bluetooth® protocol, and may include a Bluetooth® receiver circuit board. In such embodiments, audio source 70 must also be Bluetooth® enabled. Alternatively, other wireless protocols and/or transmissions are contemplated by the present invention.

The crossovers 58, which may be professional quality, direct the proper sound frequencies to the appropriate speakers. The crossovers 58 may be used to aid in the filtering, splitting, and guidance of sound frequencies to the proper speaker units. The crossovers 58 may have a capacity of, for example, 12 dB/octave. The crossovers 58 may be active or passive. When the crossovers 58 are active crossovers, they may use Digital Signal Processing (DSP). This digitally separates frequencies (e.g., 55-300 Hz and 300-20,000 Hz) into two separate channels that then each require amplification. This may require the need for a 4-channel amplifier (one channel per speaker, e.g., two subwoofers and two tweeters). The one or more crossovers 58 may optionally be designed such that the system includes one crossover unit per stereo channel.

The converter 56 may also be included as part of the electronics encompassed in the cavity 25 of shell 20. As is known by an individual of ordinary skill in the art, a converter is an electronic circuit which converts a source of direct current from one voltage level to another and can be used to power the amplifier 54. In some embodiments, the converter 56 may be a buck converter, such as a 12V to 5V buck converter. In other embodiments, the converter 56 may be a boost converter, such as a 12V to 15V DC boost converter. In some embodiments, the converters used can be high efficiency boost or buck converters. However, any voltage and type of converter necessary to effect power to the system 10 is contemplated by the present invention.

The battery 52 may be included to power the entire system 10. The power charging port 66 (FIG. 3) may permit attachment of a battery charger to the system 10 for charging the battery 52. The battery 52 may optionally be a 5V battery, a 12V battery, or any useable voltage. In some embodiments, the battery 52 may take the form of a 12V 6800 mAh lithium ion battery. Lithium batteries can increase playing time with minimum weight added to the system. Lithium batteries can deliver a high number of milliampere hours for their weight. A battery charger may also be included which can connect to the charging port 66 for charging battery 52.

The amplifier 54 magnifies low-power audio signals to levels suitable for driving the speakers 30, 40. As illustrated, the amplifier 54 is in audio communication with the speakers 30, 40, as well as with the crossovers 58 and receiver 50. The amplifier 54 must be powered in order to function, and, as mentioned above, may be powered by the converter 56. In some embodiments, the amplifier 54 may be Class D, which can provide extremely high efficiency amplification using Pulse-Width Modulation (PWM). This can permit long battery life (>12 hours) at loud volume levels. The amplifier 54 may be a 25-watt amplifier, but the amplifier wattage may approximately or substantially match the speaker maximum wattages.

In a further embodiment, the Bluetooth® system may include a Bluetooth® receiver circuit board.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A speaker system comprising:

a dome-shaped shell comprising an outside surface and defining an internal cavity;

a receiver configured to receive audio signals from a wireless-enabled device and positioned in the internal cavity; and a plurality of speakers in audio communication with the receiver, wherein the wireless receiver and speakers are configured to project audio outward of the dome-shaped shell, wherein the plurality of speakers comprise:

a first plurality of speakers positioned on the outside surface of the dome-shaped shell and that are facing outward and partially forward from the dome-shaped shell; and a second plurality of speakers positioned entirely within the internal cavity and facing partially downward and partially forward, wherein the first and second plurality of speakers are configured to project audio outward of the dome-shaped shell in at least a partially forward direction.

2. The speaker system of claim 1, wherein at least some of the first plurality of speakers are facing at least partially upward and partially forward and configured to project audio outward of the dome-shaped shell in at least a partially forward direction.

3. The speaker system of claim 2, wherein a first speaker of the at least partially upward and partially forward-facing speakers is partially leftward facing and a second speaker of the at least partially upward and partially forward-facing speakers is partially rightward facing.

4. The speaker system of claim 1, wherein the second plurality of speakers comprises subwoofers.

5. The speaker system of claim 1, wherein the first plurality of speakers comprises tweeters.

6. The speaker system of claim 1, further comprising a first cabinet positioned inside the dome-shaped shell and a second cabinet positioned inside the dome-shaped shell, and at least one speaker of each of the first plurality of speakers and second plurality of speakers being positioned at least partially within the first cabinet and the second cabinet, respectively.

7. The speaker system of claim 1, further comprising a plurality of cabinets positioned inside the dome-shaped shell, each speaker of the first plurality of speakers having a corresponding cabinet in which each speaker of the first plurality of speakers is at least partially positioned within, and each of the second plurality of speakers being positioned at least partially within one cabinet of the plurality of cabinets.

8. The speaker system of claim 1, wherein the dome-shaped shell comprises the shape of a sports helmet.

9. The speaker system of claim 8, wherein the dome-shaped shell comprises the shape of a football helmet.

10. The speaker system of claim 9, wherein the football helmet is regulation sized.

11. The speaker system of claim 1, wherein the receiver comprises a Bluetooth receiver.

12. The speaker system of claim 1, further comprising an audio source in communication with the receiver.

13. The speaker system of claim 12, wherein the audio source comprises a mobile device.

14. The speaker system of claim 13, wherein the mobile device comprises a smartphone.

15. The speaker system of claim 13, wherein the mobile device comprises a tablet computer.

16. A method of audio projection comprising:

receiving a wireless audio signal inside an internal cavity defined by a dome-shaped shell, the dome-shaped shell comprising an outside surface;

projecting audio from at least one upward and forward-facing speaker positioned on the outside surface of the dome-shaped shell; and projecting audio from a plurality of downward and forward-facing speaker positioned entirely within the internal cavity.

17. The method of claim 16, further comprising:

manufacturing a speaker system comprising:

providing the dome-shaped shell having an internal cavity;

positioning a plurality of speakers in the downward and forward-facing direction entirely within the internal cavity;

positioning the at least one speaker in the upward and forward-facing direction on the outside surface of the dome-shaped shell; and connecting the speakers in audio communication with a wireless receiver positioned inside the internal cavity, such that audio may be projected from the speakers outward of the dome-shaped shell in at least a partially forward direction.

18. A speaker system comprising:

a sports helmet shell having an outside surface and a front opening;

a wireless receiver configured to receive audio from a wireless-enabled device;

at least one speaker positioned on the outside surface and above the front opening such that it is facing outward of the sports helmet shell and at least partially upward and at least partially forward; and a plurality of speakers positioned inside the sports helmet shell and facing outward of the front opening and at least partially downward and at least partially forward, wherein the wireless receiver is in audio communication with the speakers to project audio therefrom in a direction outward and forward of the sports helmet shell.

* * * * *